United States Patent [19]

Cullinane

[11] Patent Number: 4,825,590

[45] **Date of Patent: * May 2, 1989**

[54] RECEPTACLE HANGER

[76] Inventor: Dolores M. Cullinane, 8900 - 2nd Ave., NE., Seattle, Wash. 98115

[ * ] Notice: The portion of the term of this patent subsequent to Apr. 26, 2005 has been disclaimed.

[21] Appl. No.: 92,660

[22] Filed: Sep. 3, 1987

Related U.S. Application Data

[63] Continuation-in-part of Ser. No. 943,208, Dec. 18, 1986, Pat. No. 4,739,582.

[51] Int. Cl.[4] ..... A01G 9/02; A47K 1/08

[52] U.S. Cl. ..... 47/67; 248/225.1; 248/311.2; 47/39

[58] Field of Search ..... 248/311.2, 213.2, 215, 248/225.1, 222.4, 207, 315, 224.4, 263, 229.2, 227; 211/71; 47/39, 67, 41 R, 41.12, 41.13, 41.11, 66; 220/85 H, 94 R, 96; 24/599, 598, 698, 700, 701, 588, 589, 702; 403/254, 353, 407.1

[56] References Cited

U.S. PATENT DOCUMENTS

| | | | |
|---|---|---|---|
| 1,226,101 | 5/1917 | Marsden . | |
| 1,245,744 | 11/1917 | Leibner . | |
| 1,329,651 | 2/1920 | Carmody . | |
| 1,343,363 | 6/1920 | Hall . | |
| 1,539,850 | 6/1925 | Kostenbauder . | |
| 1,930,673 | 10/1933 | Consolazio | 248/20 |
| 2,025,707 | 12/1935 | Consolazio | 248/315 |
| 2,451,550 | 10/1948 | Haller | 248/315 |
| 2,536,725 | 1/1951 | Cleveland | 211/71 |
| 2,745,619 | 5/1956 | Osborne | 248/226 |
| 3,027,014 | 3/1962 | Lindblom | 211/71 |
| 3,432,136 | 3/1969 | Penney | 248/315 |
| 3,477,679 | 11/1969 | Lovitz | 248/311.2 |
| 3,553,888 | 1/1971 | Daly et al. | 47/41.1 |
| 4,102,080 | 7/1978 | Kojo | 47/67 |
| 4,133,509 | 1/1979 | Kalbow et al. | 248/313 |
| 4,137,668 | 2/1979 | Kojo | 47/66 |
| 4,381,623 | 5/1983 | Koistinen | 47/48.5 |
| 4,393,622 | 7/1983 | Gallo, Sr. | 47/48.5 |
| 4,405,109 | 9/1983 | Murdock | 248/215 |
| 4,418,496 | 12/1983 | Koistinen | 47/41.12 |
| 4,697,780 | 10/1987 | Wenkman et al. | 248/311.2 |

*Primary Examiner*—Robert A. Hafer
*Assistant Examiner*—Danton D. DeMille
*Attorney, Agent, or Firm*—Delbert J. Barnard

[57] ABSTRACT

A hook (44, 60) at an upper forward portion of a mount (14, 66, 66') extends into a horizontal slot (24, 102) formed in an upper sidewall portion (18, 104) of a container (10, 58). A stem (54) may extend downwardly from the hook (48), for insertion into a vertical opening (26) in the container sidewall (18). The holder (14, 66, 66') includes a front leg (32, 38, 68') which extends downwardly from the hook (44, 60) and presents a front surface (55, 76, 76') against which a lower sidewall portion of a container (10) may lie. A protrusion (56, 90, 98) may extend rearwardly from a lower portion of the front leg (32, 68, 68'). A mounting hook (34, 66) extends rearwardly from the upper end of the leg (32, 68, 68') and clips onto an upper edge portion of a support structure (12, 64).

7 Claims, 2 Drawing Sheets

14
12
44
20
10
18
16

14
36
44
48
46
54
32
56
38
42
40

34
36

52
48
28
30
22
38
54
40
56
24
26
18
10

36
34
14
50
12
44
48
46
54
38
32
40
42
56
36
34
14
38
40
56

36
52
48
54
14
32

28
52
48
32
30
46
54
26
56

Fig. 8
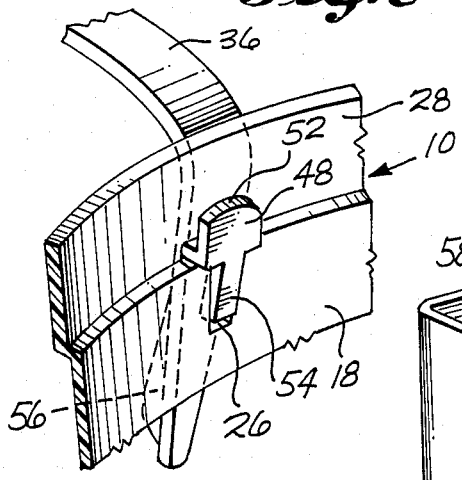
Fig. 9
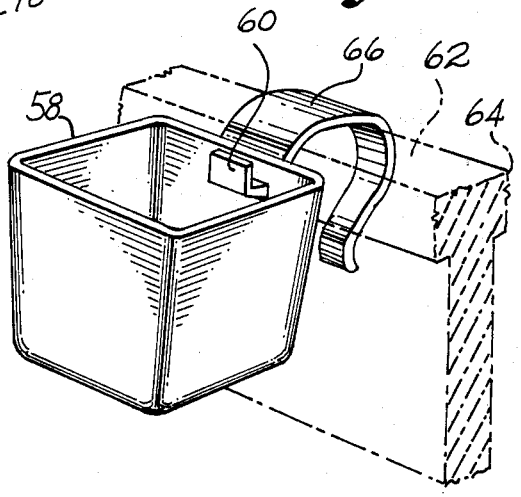
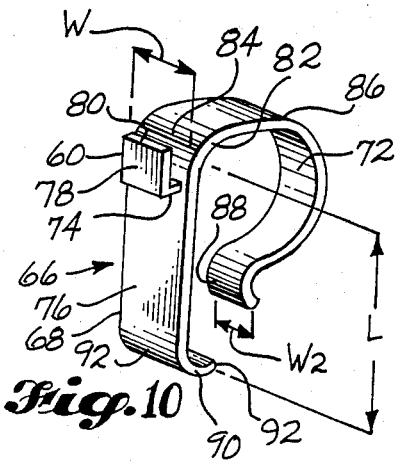
Fig. 10
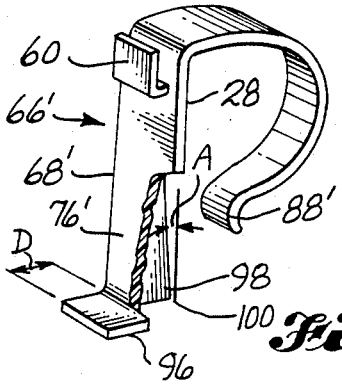
Fig. 11
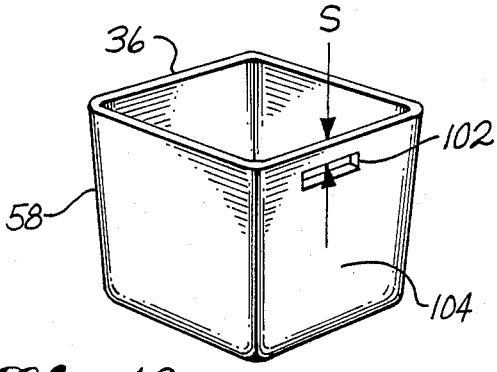
Fig. 12

RECEPTACLE HANGER

RELATED APPLICATION

This application is a continuation-in-part of my copending application Ser. No. 943,208, filed Dec. 18, 1986 U.S. Pat. No. 4,739,582 and entitled Holder And Attachment Bracket For Floral Arrangement. The contents of application Ser. No. 943,208 are hereby incorporated herein by this express reference.

BACKGROUND ART

U.S. Pat. No. 4,418,496, granted Dec. 6, 1983 to Arnold A Koistinen discloses a hanger for a variety of floral containers, each of which is of a special construction and includes an opening in tis lower end which receives an upwardly extending, tapered peg which is provided at the lower end of the hanger. In one embodiment, the peg fits into an axial socket provided at the bottom of the container. The socket is sized such that it frictionally engages the conical surface of the peg to hold the container in place. In another embodiment, the peg extends into an opening in the bottom of a pan. The pan receives a block of floral foam which supports flower stems or the like and is saturated with water. In another embodiment, the peg extends through an opening in the bottom of a taller container. The container includes an upper back member which is positioned rearwardly of a mounting leg member for the tapered peg, at a location spaced above the peg.

It is an object of the present invention to provide a receptacle mount which includes an upper end hook which engages an opening in an upper sidewall portion of a container, and which is constructed to permit use of a flat bottom floral container, permitting use of the same flowers on a table, as table decoration.

DISCLOSURE OF THE INVENTION

The mount of the present invention is adapted for supporting a receptacle of a type having a sidewall extending upwardly from a flat bottom to an open top and an opening in the sidewall closely adjacent the open top. In basic form, the mount comprises a front part and a rear mounting hook extending rearwardly from the front part and then downwardly. The rear mounting hook in use engages an upper portion of a support structure (e.g. an end wall of a church pew) to secure the mount to the support structure with the front part depending from the mounting hook on a side of the support structure. The front part includes a receptacle hook having a base portion which extends forwardly from the front portion and a front portion which extends upwardly from the base portion. A hook throat is defined by and between the front portion of the receptacle hook and an adjacent portion of the front part. The base portion of the receptacle hook extends through the opening in the sidewall of the receptacle. A sidewall portion of the receptacle above the opening is located in the hook throat. A lower edge of such sidewall portion, positioned above the sidewall opening, rests on the base portion of the receptacle hook. In this manner the weight of the receptacle and its contents are transferred to the receptacle mount.

In preferred form, the receptacle mount includes a vertically elongated front leg and the receptacle, below where it is engaged by the receptacle hook, rests against a front surface of the front leg. This contact helps stabilize the receptacle in position.

In accordance to an aspect of the invention, the sidewall opening in the receptacle has a horizontally elongated upper portion and a vertially elongated lower portion. The front leg of the receptacle mount includes a stem portion extending vertically downwardly from the front portion of the receptacle hook. The front portion of the receptacle hook fits into the upper portion of the opening in the sidewall of the receptacle. The stem portion of the mount fits into the lower portion of the opening in the sidewall of the receptacle. This prevents the receptacle from swinging sideways relative to the mount.

According to another aspect of the invention, the mount includes means projecting rearwardly from at least a lower portion of the front leg of the receptacle mount, to contact the support structure and help establish the attitude of the receptacle mount on the support structure.

Other more detailed features of the invention are herein after described as a part of the description of the best mode.

BRIEF DESCRIPTION OF THE DRAWING

Like reference numerals are used to designate like parts throughout the several views of the drawing, and:

FIG. 8 is an enlarged scale fragmentary view of the connection between the receptacle hook and the hook receiving opening in the receptacle;

FIG. 9 is an isometric view of a second embodiment of the invention, such view including a phantom line showing of an upper portion of a support structure;

FIG. 10 is an isometric view of of the mount shown in FIG. 9;

FIG. 11 is an isometric view of a third embodiment of the mount, with a lower foreground portion of the front leg cut away to disclose a web that is on the rear side of the front leg; and FIG. 12 is an isometric view of a receptacle of a type usable with the embodiments shown by FIGS. 9–11.

BEST MODE FOR CARRYING OUT THE INVENTION

Figures 1, 2, 3, 4, 5, 6, 7:
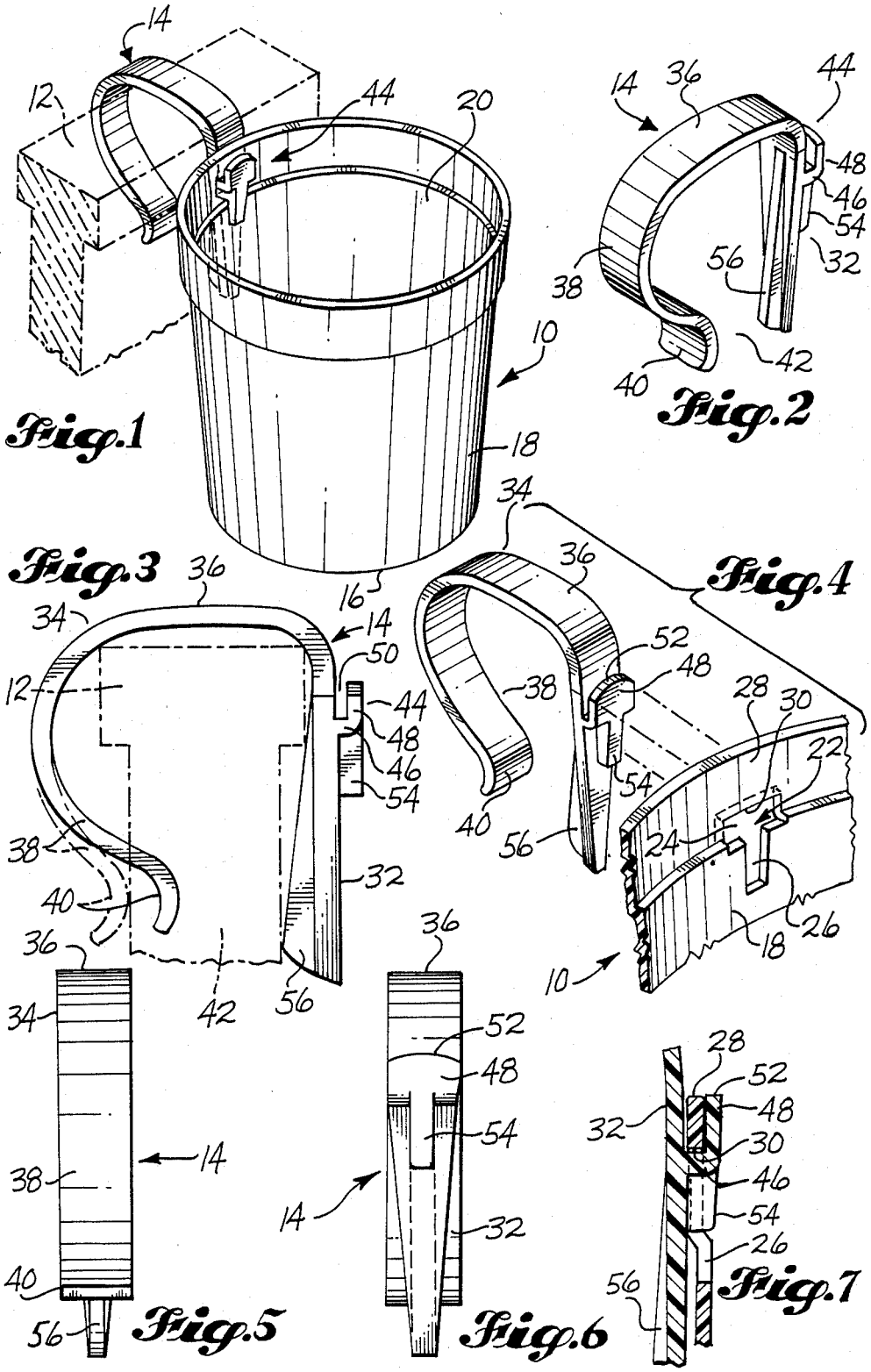
FIG. 1 is an isometric view taken from above and looking towards the front and one side of a receptacle and a mount for the receptacle joined together, such view including a phantom line showing of an upper portion of an end of a church pew or a similar support structure.
FIG. 2 is an isometric view of the receptacle mount, taken from above and looking towards one side and the rear.
FIG. 3 is a side elevational view of the receptacle mount, such view including a portion of a support structure in phantom and by broken line showing the mounting hook portion of the receptacle mount clipped onto the support structure.
FIG. 4 is an exploded isometric view, taken from above and toward the front and one side of the receptacle mount, and showing a fragmentary portion of a receptacle spaced from the front of the receptacle mount.
FIG. 5 is a rear elevational view of the receptacle mount.
FIG. 6 is a front elevational view of the receptacle mount.
FIG. 7 is an enlarged scale fragmentary view showing the connection between the receptacle mount and the receptacle, with both the receptacle mount and the receptacle being shown in section.

FIG. 1 shows a receptacle 10 secured to an upper portion of a support structure 12 by means of a receptacle mount 14.

The receptacle 10 has a closed bottom 16 and a sidewall 18 which extends upwardly from the bottom 16 to an open top 20. In accordance with the invention, an opening 22, best shown in FIG. 4, is formed in an upper portion of the sidewall 18. Opening 22 has a horizontally elongated upper portion 24 and a vertically elongated lower portion 26. The portion 26 is preferably positioned to intersect the central part of the portion 24, giving the opening 24 a substantially T-shape. A sidewall portion 28 of receptacle 10 is located above opening 22. It includes a lower edge 30.

The receptacle mount 14 has a front part which in preferred form is a vertically elongated front leg 32. Receptacle mount 14 also includes a rear mounting hook 34 which extends from the upper end of front leg 32, rearwardly and then downwardly. It includes a top part 36 which in use extends over the top of the mounting structure 12. It also includes a back part 38 which is curved in the manner illustrated and which may include a lower end portion 40 of reverse curvature. A hook throat 42 is formed by and between the lower portion 40 and the lower part of front leg 32. As best shown by FIG. 3, the hook throat 42 is normally narrower than support structure 12.

During installation of the receptacle mount 14 onto the support structure 12, the hook throat 42 is opened, to allow entry of the support structure 12 into the hook throat. That is, hook parts 38, 40 are moved away from front leg 32. The mounting hook 34 is in the nature of a spring. The movement of its rear portions 38, 40 away from the front leg 32 stores spring energy which serves to clamp the receptacle mount 14 onto the support structure 12. There are structural plastics available which are capable of storing spring energy. Preferably, the receptacle mount 14 is constructed from such a structural plastic.

In accordance with the invention, a receptacle hook 44 is provided at an upper front location on the front leg 32. Receptacle hook 44 includes a base portion 42 which projects forwardly of the front leg 32. It also includes a front portion 48 which projects upwardly from the base portion 46. A hook throat 50 is formed by and between the front portion 48 and an adjacent upper part of the front leg 32. As illustrated, the front portion 48 may include an upper edge 52 of convex curvature.

In preferred form, a stem 54 extends vertically downwardly from the front portion 50 and horizontally forwardly from the front leg 32. The front faces of hook portion 48 and stem 54 may lie in a common plane.

The receptacle 10 and the receptacle mount 14 are connected together in the following manner. The upper edge part 52 of the front portion 50 of receptacle hook 44 is inserted into the upper portion 24 of opening 22. The receptacle mount 14 and the receptacle 10 are then moved to swing the hook part 48 through the opening part 24, and place the stem 54 into the opening part 26 and the sidewall part 28 into the hook throat 50. The wall 18 is thin and distorts each to allow first the upper portion 52 of the hook, and then the entire hook 48 and the stem 54 to engage the opening 22. The receptacle 10 moves downwardly until the edge 30 rests on and is supported by the base portion 46 of receptacle hook 44. The horizontally elongated nature of hole portion 24 and the interfit of the stem 54 into the opening portion 26 interlock the receptacle mount 14 and the receptacle 10 in a manner preventing sideways rotation of the receptacle 10 relative to the receptacle mount 14. The receptacle 10 makes contact at its lower end with the front surface 55 of the leg 32.

The support structure 12 in the illustrated example is in the nature of a wall and a top rail on the wall which is wider than the wall. In preferred form, the front leg 32 is formed to include a rearwardly projecting web 56 which increases in depth (i.e. dimension away from leg 32) as it extends downwardly. As best shown by FIG. 3, the lower portion of the web 56 projects rearwardly of the front leg 32 and contacts a side surface of the support structure 12 below the top rail. The web 56 helps to determine the attitude of the receptacle mount 14. In the illustrated example it compensates for the support structure 12 being wider at its top (at the top rail) than it is below the top. Web 56 may form a similar function when the receptacle mount 14 is placed on a support wall 12 which does not include a wider top portion, but which includes a decorative carving having recesses into the surface. The web 56 may extend into a recess and help position the receptacle mount 14 so that the front face of the front leg 32 and the front portion 48 of the receptacle hook 44 are substantially vertical.

Web 56 also helps to stiffen the front leg 32. As a result, when the receptacle mount 14 is being installed onto a support structure 12, the bending necessary to open the hook throat 42 will occur in the mounting hook regions 36, 38, 40.

Referring to FIG. 9, receptacle 58 is held by hook 60 which is clipped over the top 62 of structure 64, representative of the end of a pew or the like.

Mount 66 is shown completely in FIG. 10. It comprises a front leg 68, a receptacle hook 60 and clip portion or mounting hook 72. Hook 60 comprises a lower section 74, oriented at 90° to face 76 of the front leg 68 and perpendicular to the long axis of the front leg 68, and an upright section 78, essentially perpendicular to section 74 and extending upwardly with its top edge 80 essentially level with top end 82 of the strut. Section 78 parallel to face 76 and a distance away from it slightly greater than the thickness of the wall of the holder, described below.

Clip portion 72 comprises a first curved section 84 starting at edge 80 curving away from face 76 and having an arc length in the range of 80° to 90° and an inside radius in the range of $\frac{1}{2}$ to $\frac{1}{3}$ the width W of the top edge 80. It further comprises second and third curved sections. Second section 86 curves in the same direction as the first section and has an arc length in the range of 170° to 190° and an inside radius in the range of $\frac{1}{3}$ to $\frac{1}{2}$ the length of the strut portion. The third section 88 curves in the opposite direction, has an arc length in the range of 1/10 to $\frac{1}{4}$ the radius of the second section. The width of the clip is equal to the width W at the junction of the clip and strut portions. The clip may have a constant width or the width may taper to width $W_2$ at the end of the third section of the slip. Width $W_2$ is in the range of $\frac{1}{2}$ to $\frac{1}{4}$ of width W.

There is curved portion 90 at the lower end 92 of the strut forming protuberance from the strut. It is curved in the same direction from the plane of the strut as the clip portion. The radius of portions 90 is in the range of $\frac{1}{8}$ to $\frac{1}{3}$ of width W. Tip 92 of portion 90 lies in a plane which intersects the back surface 28 of the strut at the top 21 of the strut. The angle between that plane and surface 94 is denoted A.

FIG. 11 illustrates another embodiment of the attachment apparatus. In this embodiment lip 96 extends from the lower end of the leg or strut 68' in the same direction as the hook 60. It is essentially perpendicular to face 76' of the strut 68' and extends a distance D from the face. Distance D is in the range of ⅛ to ¼ of length L. In this embodiment proturberance 98 extends outward from the back surface of the strut. The outward extreme tip 100 of the protuberance lies in a plane which intersects the back surface of the strut at the top of the strut. The angle between that plane and surface 28 is equal to the angle denoted A.

In both embodiments of FIGS. 10 and 3, the points 88, and 88' of closest proximity of the clip portion to the strut portion are at a distance from the back surface of the strut in the range of ¾ of an inch to 1¼ inches. The material from which the clip is made allows deformation of the clip to increase this dimension to as much as 2½ inches. These points of closest proximity are essentially opposite the lengthwise mid-points of the struts. The second face of the strut faces the outer surface of the end of the pew or the like and the clip contacts the inner surface of the end.

The holder 58 of the subject invention, usable with the mounts 66, 66' is illustrated in FIG. 12. It comprises a thin-walled plastic, commercially available, open-topped container 58 having essentially cubical proportions in this embodiment. The container can be of any appropriate size and shape provided it has at least one flat surface such as side 34 of the subject container, the side having a thickness of 1/32 of an inch and width and length no less than those of the attachment bracket. There is a slot 102. The slot is a distance S below rim 36 and centered in side 104 with its long sides parallel to rim 36. The slot is 6 to 10 times its width. The length is 1¼ to 1½ times the width W of hook 60. This extra length allows the side of distort enough to permit the container to be installed on the hook with the opening surrounding the first section of the hook. The width is slightly greater than the thickness of the first section of hook 60.

The sides of the container 58 are sloped inward from top to bottom; i.e. the container is tapered to allow the containers to be stacked. The angle between side 34 and a plane perpendicular to the plane of the rim 36 and intersecting the juncture of side 104 with the bottom of its container is essentially equal to the angle denoted A. This assures that the rim 36 of the container 58 is horizontal when it is installed on the bracket and the strut is positioned on a vertical surface and vertically in plan view.

Preferred embodiments of the subject invention are described herein. However, it will be understood by those skilled in the art that other embodiments and variations and modifications of those described are possible within the scope of the subject invention.

What is claimed is:

1. A mount for a receptacle of a type having a sidewall extending upwardly from a bottom to an open top and an opening in the sidewall closely adjacent the open top, said mount comprising:

a vertically elongated front leg having upper and lower ends and a front surface;

a rear mounting hook extending from the upper end of the leg, first rearwardly and then downwardly, said rear mounting hook in use engaging an upper portion of a support structure, to secure the mount to the support structure with the front leg depending from the mounting hook on a side of the support structure;

said front leg including a receptacle hook adjacent its upper end, said receptacle hook having a base portion which extends forwardly from the leg and a front portion which extends upwardly from the base portion;

a hook throat defined by and between the front portion of the receptacle hook and an adjacent upper front portion of the front leg;

said front portion of the receptacle hook being sized and shaped to be inserted into the opening in the sidewall of the receptacle;

said hook throat being dimensioned to receive and accommodate a portion of the sidewall of the receptacle situated above the opening of the sidewall of the receptacle, following an insertion of the front portion of the receptacle hook through the opening in the sidewall of the receptacle;

said front surface of said front leg making stabilizing contact with the receptacle below the opening in the sidewall of the receptacle when the receptacle is hanging from said receptacle hook; and wherein the rear mounting hook has a downwardly directed hook entrance which is normally narrower than the upper portion of the support structure to which the receptacle mount is to be attached, and said rear mounting hook is readily bendable in position away from the front leg, so that the downwardly directed hook throat can be enlarged for receiving the upper portion of the support structure, said rear mounting hook being stiff enough to spring back towards its normal position after being placed on the support structure, and said front leg including a rearwardly directed stiffening web.

2. A receptacle mount according to claim 1, wherein said stiffening web increases in depth as it extends downwardly and at the lower end of the front leg presents a contact portion which contacts the support structure and helps establish the attitude of the receptacle mount on the support structure.

3. A mount for a receptacle of a type having a sidewall extending upwardly from a bottom to an open top and an opening in the sidewall closely adjacent the open top, said mount comprising:

a vertically elongated front leg having upper and lower ends and a front surface;

a rear mounting hook extending from the upper end of the leg, first rearwardly and then downwardly, said rear mounting hook in use engaging an upper portion of a support structure, to secure the mount to the support structure with the front leg depending from the mounting hook on a side of the support structure;

said front leg including a receptacle hook adjacent its upper end, said receptacle hook having a base portion which extends forwardly from the leg and a front portion which extends upwardly from the base portion;

a hook throat defined by and between the front portion of the receptacle hook and an adjacent upper front portion of the front leg;

said front portion of the receptacle hook being sized and shaped to be inserted into the opening in the sidewall of the receptacle;

said hook throat being dimensioned to receive and accommodate a portion of the sidewall of the receptacle situated above the opening of the sidewall of the receptacle, following an insertion of the front portion of the receptacle hook through the opening in the sidewall of the receptacle;

said front surface of said front leg making stabilizing contact with the receptacle below the opening in the sidewall of the receptacle when the receptacle is hanging from said receptacle hook; and means extending rearwardly from at least a lower portion of the front leg of the receptacle mount comprising a web which extends rearwardly from the front leg and increases in depth as it extends downward, said web contacting the support structure to help establish the attitude of the receptacle mount on the support structure.

4. In combination:

a receptacle having a bottom, an open top, a sidewall extending upwardly from the bottom to the open top, an opening in the sidewall closely adjacent the open top, and a sidewall portion above the opening having a lower edge; and a receptacle mount comprising:

a front part;

a rear mounting hook extending from the front part rearwardly and then downwardly, said rear mounting hook in use engaging an upper portion of a support structure, to secure the mount to the support structure with the front part depending from the mounting hook on a side of the support structure;

said front part including a receptacle hook having a base portion which extends forwardly from the front portion and a front portion which extends upwardly from the base portion;

a hook throat defined by and between the front portion of the receptacle hook and an adjacent portion of the front part;

said base portion of the receptacle hook extending through the opening in the sidewall of the receptacle; and said sidewall portion of the receptacle above the opening being located in the hook throat and said lower edge resting on the base portion of the receptacle hook, wherein the weight of the receptacle and its contents are transferred to the receptacle mount by the contact between the edge surface of the sidewall portion above the opening in the sidewall of the receptacle and the base portion of the receptacle hook, and wherein the front part of the receptacle mount is a front leg which depends from the rear mounting hook along a side of the support structure, the receptacle hook is located adjacent the upper end of the front leg, and the receptacle contacts said front leg below the sidewall opening in the receptacle, and wherein the opening in the sidewall of the receptacle comprises a horizontally elongated upper portion and a vertically elongated lower portion, and wherein the front leg of the receptacle mount includes a stem portion extending vertically downwardly from the front portion of the receptacle hook, and wherein the step portion fits into the lower portion of the opening in the sidewall of the receptacle.

5. The combination of claim 4, comprising means projecting rearwardly from at least a lower portion of the front leg of the receptacle mount, to contact the support structure and help establish the attitude of the receptacle mount on the support structure.

6. The combination of claim 5, wherein the means extending rearwardly from the front leg of the receptacle mount comprises a web which extends rearwardly from the front leg and increases in depth as it extends downwardly.

7. A mount for use with a receptacle of a type having a sidewall extending upwardly from a bottom to an open top and an opening in the sidewall closely adjacent the open top, said mount comprising:

a vertically elongated front leg having upper and lower ends and a front surface;

a rear mounting hook extending from the upper end of the leg, first rearwardly and then downwardly, said rear mounting hook in use engaging an upper portion of a support structure, to secure the mount to the support structure with the front leg depending from the mounting hook on a side of the support structure;

said front leg including a receptacle hook adjacent its upper end, said receptacle hook having a base portion which extends forwardly from the leg and a front portion which extends upwardly from the base portion;

a hook throat defined by and between the front portion of the receptacle hook and an adjacent upper front portion of the front leg;

said front portion of the receptacle hook being sized and shaped to be inserted into the opening in the sidewall of the receptacle;

said opening composed of a horizontally elongated upper portion and a vertically elongated lower portion, and the front leg of the receptacle mount includes a stem portion extending vertically downwardly from the front portion of the receptacle hook, and the front portion of the receptacle hook fits into the upper portion of the opening in the sidewall of the receptacle and the stem portion fits into the lower portion of the opening in the sidewall of the receptacle, with the interfit of the stem portion of the front leg of the receptacle mount with the lower portion of the opening in the sidewall of the receptacle functioning to brace the receptacle against sideways rotation;

said hook throat being dimensioned to receive and accommodate a portion of the sidewall of the receptacle situated above the opening of the sidewall of the receptacle, following an insertion of the front portion of the receptacle hook through the opening in the sidewall of the receptacle; and said front surface of said front leg making stabilizing contact with the receptacle below the opening in the sidewall of the receptacle when the receptacle is hanging from said receptacle hook.

* * * * *

UNITED STATES PATENT AND TRADEMARK OFFICE

CERTIFICATE OF CORRECTION

PATENT NO. : 4,825,590

DATED : May 2, 1989

INVENTOR(S) : Dolores M. Cullinane

It is certified that error appears in the above-identified patent and that said Letters Patent is hereby corrected as shown below:

Column 1, line 4, insert:

Technical Field

This invention relates to a support structure useful particularly by florests and others for hanging small floral arrangements on ends of church pews by the aisle for occasions such as weddings. More particularly, it relates to such a structure that will allow placement of the floral arrangement in a broad vase receptable, whereby the receptacle can also be set onto a table so that the same flowers can be used for table decorations.

Column 1, line 14, "A Koistinen" should be -- A. Koistinen --.
Column 1, line 16, "tis" should be -- its --.
Column 4, line 43, after "Section 78", insert -- is --.
Column 5, line 39, "of" should be --to--.

Signed and Sealed this

Eighth Day of May, 1990

*Attest:*

HARRY F. MANBECK, JR.

*Attesting Officer*

*Commissioner of Patents and Trademarks*